US011204034B2

(12) United States Patent
Sato et al.

(10) Patent No.: US 11,204,034 B2
(45) Date of Patent: Dec. 21, 2021

(54) SCROLL FLUID MACHINE WITH DECREASING INTER-FACING SURFACE AND ARC SHAPE END PLATE CENTRAL PORTION

(71) Applicant: MITSUBISHI HEAVY INDUSTRIES THERMAL SYSTEMS, LTD., Tokyo (JP)

(72) Inventors: Hajime Sato, Tokyo (JP); Yohei Hotta, Tokyo (JP); Yoshiyuki Kimata, Tokyo (JP); Takuma Yamashita, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 131 days.

(21) Appl. No.: 16/608,109

(22) PCT Filed: Jun. 21, 2018

(86) PCT No.: PCT/JP2018/023648
§ 371 (c)(1),
(2) Date: Oct. 24, 2019

(87) PCT Pub. No.: WO2019/035276
PCT Pub. Date: Feb. 21, 2019

(65) Prior Publication Data

US 2020/0095993 A1 Mar. 26, 2020

(30) Foreign Application Priority Data

Aug. 18, 2017 (JP) ..... JP2017-158114

(51) Int. Cl.
*F04C 18/02* (2006.01)

(52) U.S. Cl.
CPC ..... *F04C 18/0215* (2013.01); *F04C 18/0253* (2013.01); *F04C 18/0269* (2013.01); *F04C 18/0276* (2013.01); *F04C 18/0284* (2013.01)

(58) Field of Classification Search
CPC ..... F04C 18/0253; F04C 18/0269; F04C 18/0276; F04C 18/0284; F04C 2/025;
(Continued)

(56) References Cited

U.S. PATENT DOCUMENTS 5,496,161 A 3/1996 Machida et al.
2002/0054821 A1 5/2002 Takeuchi et al.
(Continued)

FOREIGN PATENT DOCUMENTS

EP 2 894 338 A1 7/2015
JP 61076185 U * 5/1986
(Continued)

OTHER PUBLICATIONS

European Communication pursuant to Article 94(3) EPC for European Application No. 18845771.7, dated Aug. 20, 2020.
(Continued)

*Primary Examiner* — Laert Dounis
(74) *Attorney, Agent, or Firm* — Birch, Stewart, Kolasch & Birch, LLP

(57) ABSTRACT

In this scroll fluid machine, a tip seal (7) that is in contact with facing end plates (5*a*) and that is for sealing in a fluid is provided to a tip seal groove (3*d*) formed on the tooth tip of a wall (3*b*). The tooth bottoms of the end plates (5*a*) have a shape in which a central section is deeper than a side section (5*d*3) in a width direction orthogonal to the spiral direction of a wall (5*b*). During operation, the protrusion amount (δ) when the tip seal (7) protrudes from the tooth tip of the wall (3*b*) in an inclined section and is in contact with the facing end plates is greater than the protrusion amount
(Continued)

(δ) when the tip seal (7) protrudes from the tooth tip of the wall (3*b*) in a flat section and is in contact with the facing end plates.

6 Claims, 13 Drawing Sheets

(58) Field of Classification Search
CPC .... F01C 1/0253; F01C 1/0269; F01C 1/0276; F01C 1/0284
See application file for complete search history.

(56) References Cited

U.S. PATENT DOCUMENTS

| | | | |
|---|---|---|---|
| 2003/0021712 | A1 | 1/2003 | Fujita et al. |
| 2003/0194341 | A1 | 10/2003 | Takeuchi et al. |
| 2020/0309131 | A1 | 10/2020 | Sato et al. |

FOREIGN PATENT DOCUMENTS

| | | | | | |
|---|---|---|---|---|---|
| JP | 1-119892 | U | | 8/1989 | |
| JP | 5-235386 | A | | 8/1994 | |
| JP | 8-28481 | A | | 1/1996 | |
| JP | 08177760 | A | * | 7/1996 | ..... F04C 18/0269 |
| JP | 9-250467 | A | | 9/1997 | |
| JP | 2002-70766 | A | | 3/2002 | |
| JP | 2002-266778 | A | | 9/2002 | |
| JP | 2002-303281 | A | | 10/2002 | |
| JP | 2003-35285 | A | | 2/2003 | |
| JP | 2005-330850 | A | | 12/2005 | |
| JP | 2008-240739 | A | | 10/2008 | |
| JP | 2009-228476 | A | | 10/2009 | |
| JP | 2010-196663 | A | | 9/2010 | |
| JP | 2014-80940 | A | | 5/2014 | |
| JP | 2015-55173 | A | | 3/2015 | |
| JP | 2018-35737 | A | | 3/2018 | |

OTHER PUBLICATIONS

International Search Report and Written Opinion of the International Searching Authority for International Application No. PCT/JP2018/023648, dated Sep. 25, 2018, with English translation.
International Search Report and Written Opinion of the International Searching Authority for International Application No. PCT/JP2018/023649, dated Sep. 25, 2018. with English translation.
Japanese Office Action for Japanese Application No. 2017-158113, dated Feb. 6, 2018, with English translation.
Japanese Office Action for Japanese Application No. 2017-158114, dated Feb. 6, 2018, with English translation.

* cited by examiner

SCROLL FLUID MACHINE WITH DECREASING INTER-FACING SURFACE AND ARC SHAPE END PLATE CENTRAL PORTION

TECHNICAL FIELD

The present invention relates to a scroll fluid machine.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As the scroll fluid machine, a so-called stepped scroll compressor which is described in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. In the stepped scroll compressor, compression (three-dimensional compression) is performed not only in a circumferential direction of the wall but also in a height direction thereof, and thus, compared to a general scroll compressor (two-dimensional compression) which does not have the step portion, an amount of displacement increases, and thus, compressor capacity can increase.

CITATION LIST

Patent Literature

[PTL 1] Japanese Unexamined Patent Application Publication No. 2015-55173

SUMMARY OF INVENTION

Technical Problem

However, in a stepped scroll compressor, there is a problem that fluid leakage in a step portion is large. In addition, there is a problem that stress concentrates on a base portion of the step portion and strength decreases.

Meanwhile, the inventors are studying to provide a continuously inclined portion instead of the step portion provided on a wall and an end plate.

In a tooth bottom against which a tooth tip serving as a tip of the wall abuts, a center in a width direction has a deepest depth. This is because semicircular contour lines are formed with both side portions in the width direction of the tooth bottom as contact points when the tooth bottom which is the inclined portion is processed by a cutting tool such as an end mill having a diameter equivalent to a width of the tooth bottom. In this way, if a deepest central portion is formed on the tooth bottom, compared to a case where the tooth bottom is flat, as a central portion of the tooth bottom is deeper, a tip seal protrudes from a tip seal groove, and a back clearance between a bottom portion of the tip seal groove and a back surface of a tip seal increases. If the back clearance increases, a refrigerant flows from a high-pressure side compression chamber to a low-pressure side compression chamber through the back clearance, and thus, performance decreases.

The present invention is made in consideration of the above-described circumstances, and an object thereof is to provide a scroll fluid machine capable of suppressing an decrease in a performance caused by the back clearance between the bottom portion of the tip seal groove and the tip seal even in a case where the continuously inclined portion is provided in the wall.

Solution to Problem

In order to achieve the above-described object, a scroll fluid machine of the present invention adopt the following means.

According to an aspect of the present invention, there is provided a scroll fluid machine including: a first scroll member having a first end plate on which a spiral first wall is provided; a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which at least one of the first wall and the second wall has a wall inclined portion, in which a height of the wall continuously decreases from the outer peripheral side toward the inner peripheral side, to form the inclined portion, at least one of the first end plate and the second end plate has an end plate inclined portion in which a tooth bottom surface facing a tooth tip of the wall inclined portion is inclined according to an inclination of the wall inclined portion, a wall flat portion whose height is not changed is provided on outermost peripheral portions and/or innermost peripheral portions of the first wall and the second wall, an end plate flat portion corresponding to the wall flat portion is provided on the first end plate and the second end plate, a tip seal which comes into contact with the facing end plate to perform sealing for a fluid is provided in a tip seal groove formed in a tooth tip of the wall, the end plate inclined portion is configured such that a central portion is deeper than a side portion in a width direction orthogonal to a spiral direction of the wall, and during an operation, a protrusion amount measured when the tip seal protrudes from the tooth tip of the wall inclined portion in the wall inclined portion and comes into contact with the facing end plate is larger than a protrusion amount measured when the tip seal protrudes from a tooth tip of the wall flat portion in the wall flat portion and comes into contact with the facing end plate.

If the end plate inclined portion is configured such that the central portion is deeper than the side portion in the width direction, the tip of the tip seal protrudes from the tip seal groove by an amount which is deeper than the side portion. Accordingly, compared to a case where the end plate inclined portion is flat, a back clearance between a bottom portion of the tip seal groove and the back surface of the tip seal increases. If the back clearance increases, a refrigerant flows from a high-pressure side compression chamber to a low-pressure side compression chamber through the back clearance, and thus, a fluid loss is generated. Accordingly, during the operation, the protrusion amount of tip seal in the wall inclined portion is made larger than the protrusion amount of tip seal in the wall flat portion. Accordingly, the back clearance of the inclined portion decreases, and the fluid loss can be suppressed as much as possible. The protrusion amount of the tip seal can be adjusted using a depth of the tip seal groove, a thickness of the tip seal, or both. In addition, the protrusion amount is an amount only during the operation, and in a case where a gas pressure is not applied to the back surface of the tip seal when the operation is stopped, the tip seal may sink into the tip seal groove and the protrusion amount may be less than or equal to zero.

In addition, in the scroll fluid machine according to the aspect of the present invention, a thickness of the tip seal in a height direction of the wall is constant in the spiral direction of the wall, and a depth of the tip seal groove is shallower in the wall inclined portion than in the wall flat portion.

In a case where the thickness of the tip seal in the height direction of the wall is constant in the spiral direction of the wall, the depth of the tip seal groove is shallower in the wall inclined portion than in the wall flat portion. Accordingly, it is possible to decrease the back clearance of the tip seal in the inclined portion.

According to another aspect of the present invention, there is provided a scroll fluid machine including: a first scroll member having a first end plate on which a spiral first wall is provided; a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which at least one of the first wall and the second wall has a wall inclined portion, in which a height of the wall continuously decreases from the outer peripheral side toward the inner peripheral side, to form the inclined portion, at least one of the first end plate and the second end plate has an end plate inclined portion in which a tooth bottom surface facing a tooth tip of the wall inclined portion is inclined according to an inclination of the wall inclined portion, a tip seal which comes into contact with the facing end plate inclined portion to perform sealing for a fluid is provided in a tip seal groove formed on each tooth tip of the first wall and the second wall corresponding to the inclined portion, the end plate inclined portion is configured such that a central portion is deeper than a side portion in a width direction orthogonal to a spiral direction of the wall, and during an operation, a protrusion amount measured when the tip seal protrudes from the tooth tip of the wall inclined portion and comes into contact with the facing end plate is smallest when the wall inclined portion is closest to the adjacent wall inclined portion.

If the end plate inclined portion is configured such that the central portion is deeper than the side portion in the width direction, during the operation, the tip of the tip seal protrudes from the tip seal groove by an amount which is deeper than the side portion. Accordingly, compared to a case where the end plate inclined portion is flat, the back clearance between the bottom portion of the tip seal groove and the back surface of the tip seal increases. If the back clearance increases, a refrigerant flows from a high-pressure side compression chamber to a low-pressure side compression chamber through the back clearance, and thus, a fluid loss is generated. Accordingly, the projection amount of the tip seal is set to be smallest in a case where the wall inclined portion is closest to the adjacent wall inclined portion. Accordingly, the fluid loss can be suppressed as much as possible. The protrusion amount of the tip seal can be adjusted using a depth of the tip seal groove, a thickness of the tip seal, or both.

In addition, in the scroll fluid machine according to the aspect of the present invention, in a case where the wall inclined portion is closest to the adjacent wall inclined portion, a protrusion amount of the tip seal is determined based on such a depth that a tip of the tip seal abuts on a position deeper than the side portion of the end plate inclined portion.

In the case where the wall inclined portions are closest to each other, if the protrusion amount of the tip seal is set based on the depth at which the tip of the tip seal abuts on the position deeper than the side portion of the end plate inclined portion, the back clearance of the inclined portion can be made as small as possible.

Advantageous Effects of Invention

An inclination portion back clearance is set to be smaller than a flat portion back clearance, and thus, an increase in a back clearance in an inclined portion is suppressed. Accordingly, it is possible to suppress a decrease in performance. The back clearance is set to be smallest in a case where a wall inclined portion is closest to an adjacent wall inclined portion, and thus, it is possible to suppress a decrease in performance.

DESCRIPTION OF EMBODIMENTS

Hereinafter, an embodiment according to the present invention will be described with reference to the drawings.

Figure 1A:
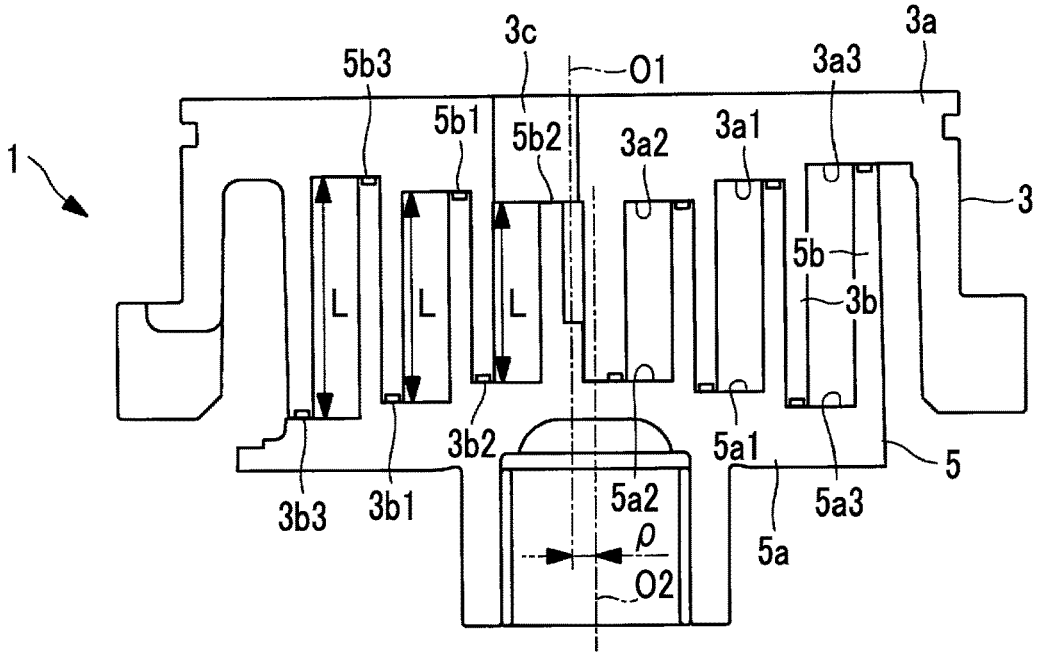
FIG. 1A is longitudinal sectional view showing a fixed scroll and an orbiting scroll of a scroll compressor according to an embodiment of the present invention.
Figure 1B:
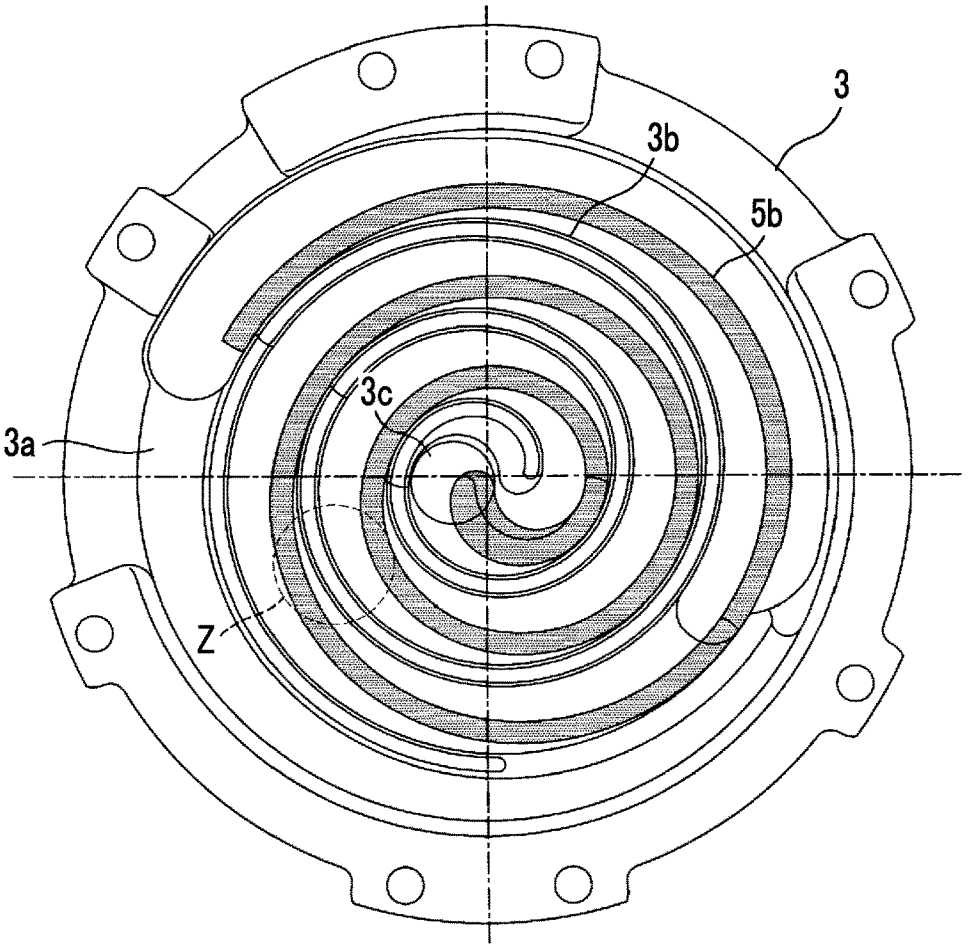
FIG. 1B is a plan view when the fixed scroll is viewed from a wall side.

In FIGS. 1A and 1B, a fixed scroll (first scroll member) and an orbiting scroll (second scroll member) 5 of a scroll compressor (scroll fluid machine) 1 are shown. For example, the scroll compressor 1 is used as a compressor which compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 suck a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius ρ, the walls 3*b* and 5*b* mesh with each other with phases deviated from each other by 180°, and a slight clearance (tip clearance) in a height direction is provided in the room temperature between tooth tips and tooth bottoms of the walls 3*b* and 5*b* of both scrolls. Accordingly, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral side of each of the spiral walls 3*b* and 5*b* toward an inner peripheral side thereof.

Figure 2:
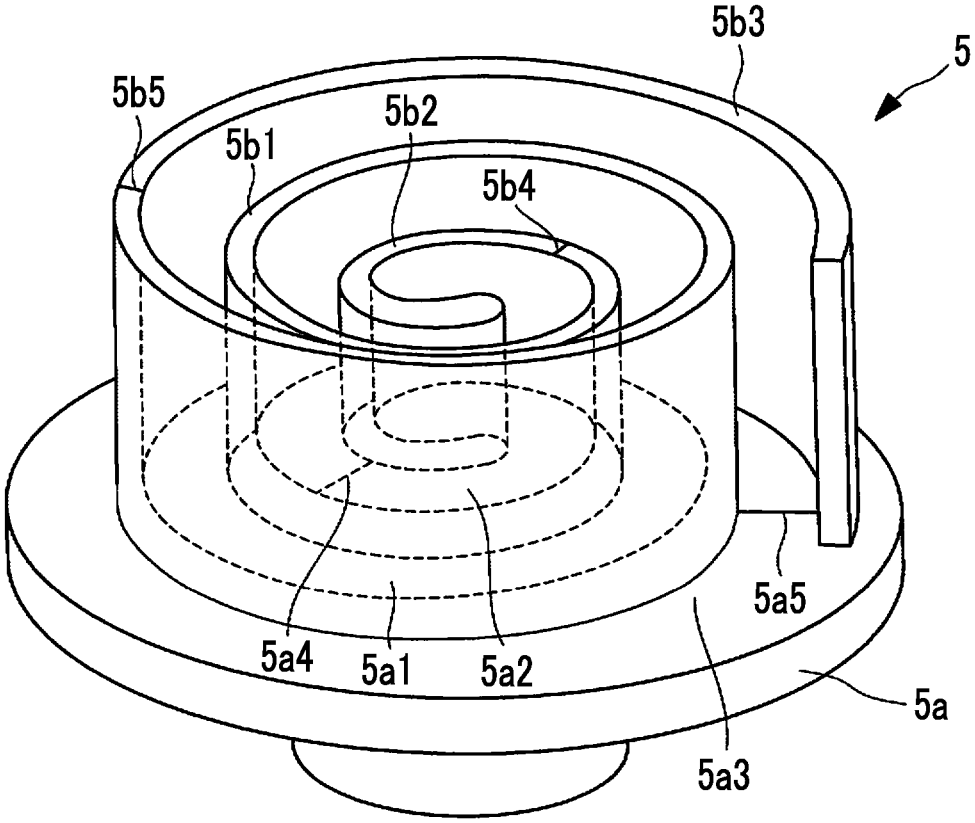
FIG. 2 is a perspective view showing the orbiting scroll of FIGS. 1A and 1B.

As shown in FIG. 2, in the wall 5*b* of the orbiting scroll 5, a wall inclined portion 5*b*1 whose height continuously decreases from an outer peripheral side toward an inner peripheral side is provided. In a tooth bottom surface of the fixed scroll 3 facing a tooth tip of the wall inclined portion 5*b*1, an end plate inclined portion 3*a*1 (refer to FIG. 1A) which is inclined according to an inclination of the wall inclined portion 5*b*1 is provided. A continuously inclined portion is constituted by the wall inclined portion 5*b*1 and the end plate inclined portion 3*a*1. Similarly, a wall inclined portion 3*b*1 whose height is continuously inclined from the outer peripheral side toward the inner peripheral side is provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclination but also includes an inclined portion in which small step portions inevitably generated during processing are connected to each other in a stepwise fashion and the inclined portion is continuously inclined as a whole. However, the inclined portion does not include a large step portion such as a so-called stepped scroll.

Coating is applied to the wall inclined portions 3*b*1 and 5*b*1 and/or the end plate inclined portions 3*a*1 and 5*a*1. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, in the tooth bottom of the end plate 5*a* of the orbiting scroll 5, end plate flat portions 5*a*2 and 5*a*3 each having a constant height are provided. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
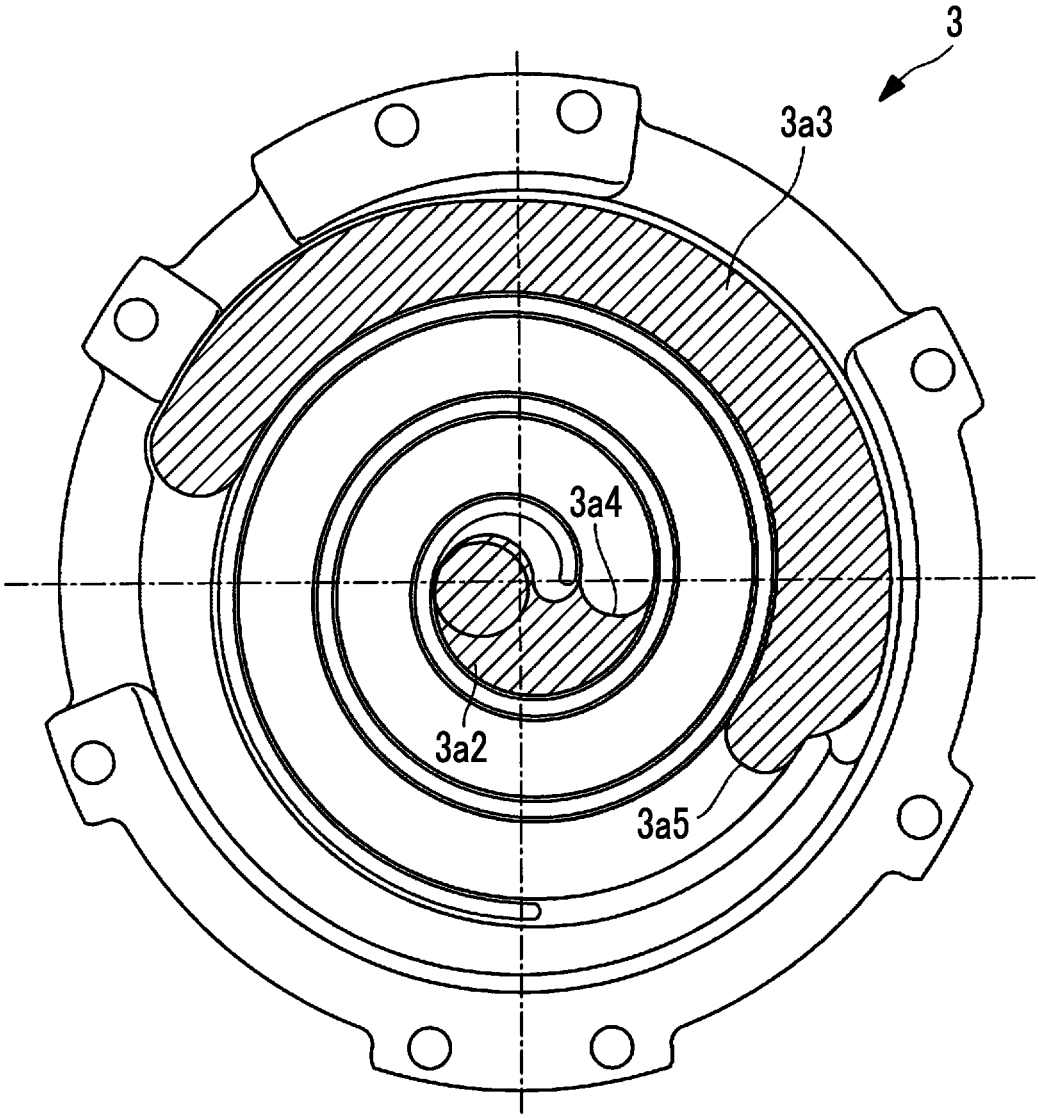
FIG. 3 is a plan view showing an end plate flat portion provided in the fixed scroll.
Figure 4:
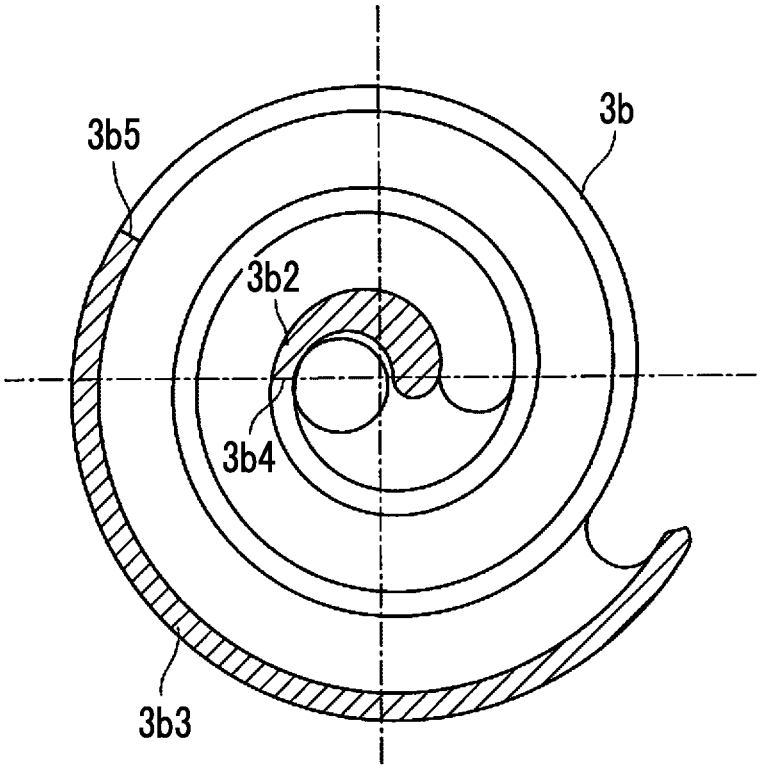
FIG. 4 is a plan view showing a wall flat portion provided in the fixed scroll.

As shown by hatching in FIGS. 3 and 4, similarly to the orbiting scroll 5, in the fixed scroll 3, end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5 are provided.

Figure 5:
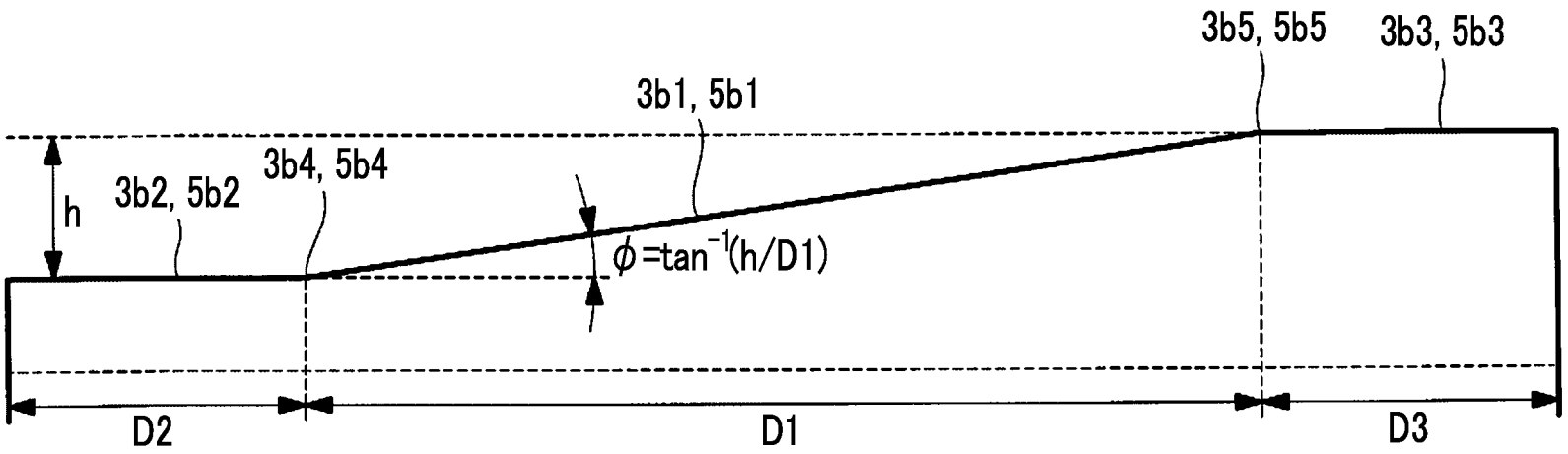
FIG. 5 is a schematic view showing a wall which is displayed to extend in a spiral direction.

FIG. 5 shows the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length corresponding to the region which becomes 180° around each of the centers O1 and O2 of the respective scrolls 3 and 5. The wall inclined portions 3*b*1 and 5*b*1 are provided over the distance D1 between the wall flat portions 3*b*2 and 5*b*2 on the innermost peripheral side and the wall flat portions 3*b*3 and 5*b*3 on the outermost peripheral side. If a height difference between each of the wall flat portions 3*b*2 and 5*b*2 on the innermost peripheral side and each of the wall flat portions 3*b*3 and 5*b*3 on the outermost peripheral side is defined as h, an inclination φ of each of the wall inclined portions 3*b*1 and 5*b*1 is represented by the following Expression.

$$\varphi=\tan^{-1}(h/D1) \quad (1)$$

In this way, the inclination φ of the inclined portion is constant in a circumferential direction in which each of the spiral walls 3*b* and 5*b* extends.

Figure 6:
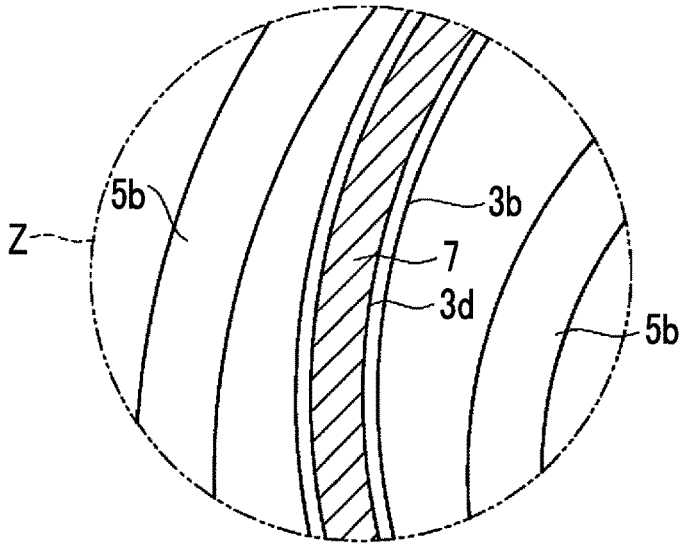
FIG. 6 is a partially enlarged view showing a region indicated by a reference sign Z in FIG. 1B in an enlarged manner.

FIG. 6 is an enlarged view showing a region indicated by a reference sign Z in FIG. 1B in an enlarged manner. As shown FIG. 6, a tip seal 7 is provided in the tooth tip of the wall 3*b* of the fixed scroll 3. The tip seal 7 is formed of a resin and comes into contact with the tooth bottom of the end plate 5*a* of the facing orbiting scroll 5 so as to perform sealing for a fluid. The tip seal 7 is accommodated in a tip seal groove 3*d* which is formed on the tooth tip of the wall 3*b* in the circumferential direction. A compressed fluid enters the tip seal groove 3*d*, presses the tip seal 7 from a rear surface thereof to push the tip seal 7 toward the tooth bottom side, and thus, the tip seal 7 comes into contact with the facing the tooth bottom. In addition, a tip seal is also provided in the tooth tip of the wall 5*b* of the orbiting scroll 5.

Figure 7A:
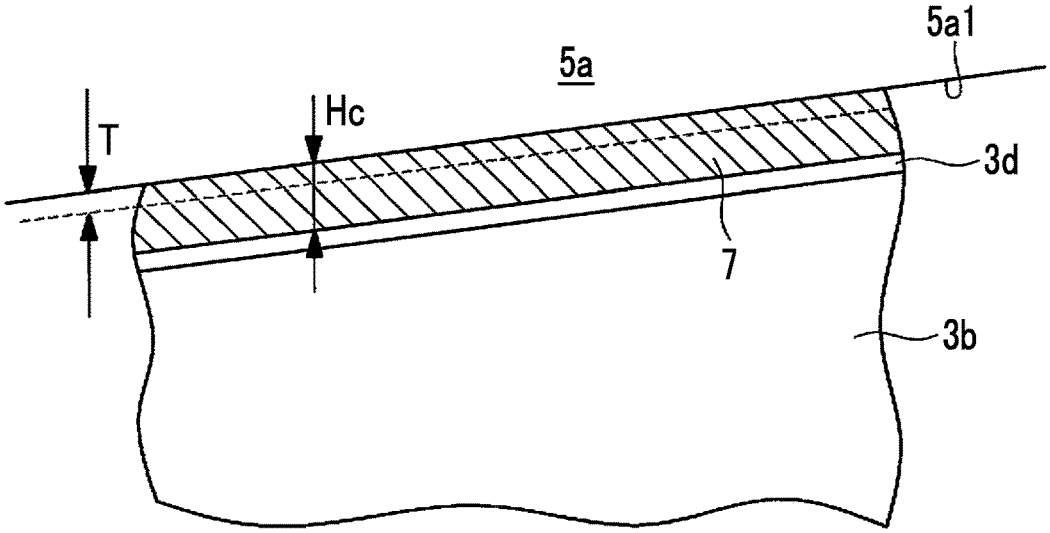
FIG. 7A is a side view showing a tip seal clearance of a portion shown in FIG. 6 and a state where the tip seal clearance relatively decreases.
Figure 7B:
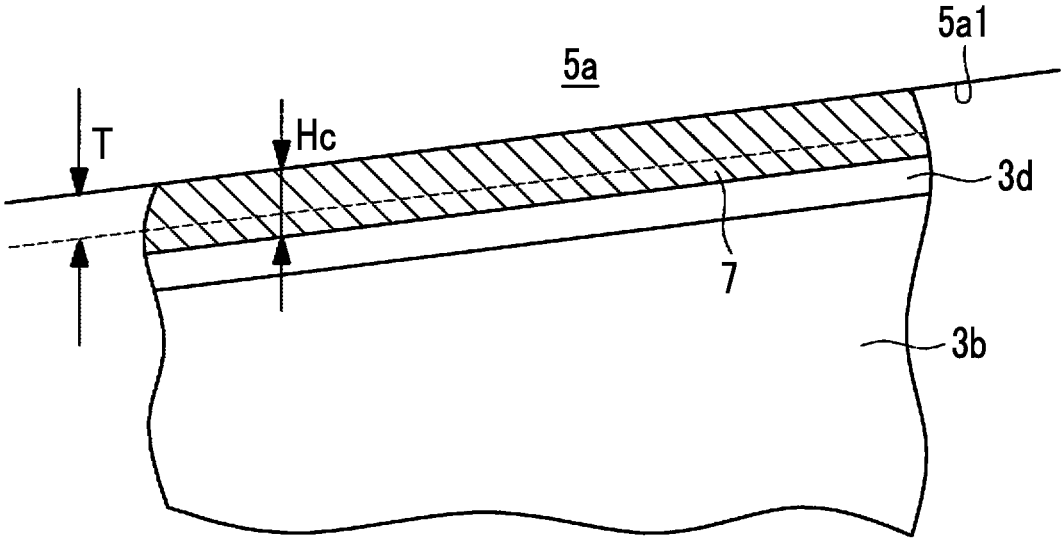
FIG. 7B is a side view showing the tip seal clearance of the portion shown in FIG. 6 and a state where the tip seal clearance relatively increases.

As shown in FIGS. 7A and 7B, a height Hc of the tip seal 7 in the height direction of the wall 3*b* is constant in the circumferential direction.

If both the scrolls 3 and 5 perform the revolution orbiting movement relative to each other, the positions of the tooth tip and the tooth bottom are relatively deviated by an orbiting diameter (orbiting radius ρ×2). In the inclined portion, the tip clearance between the tooth tip and the tooth bottom is changed due to the positional deviation between the tooth tip and the tooth bottom. For example, in FIG. 7A, a tip clearance T is small, and in FIG. 7B, the tip clearance T is large. Even when the tip clearance T is changed by an orbiting movement, the tip seal 7 is pressed toward the tooth bottom side of the end plate 5*a* by the compressed fluid from the rear surface, and the tip seal 7 can follow the tooth bottom so as to perform sealing for the tooth bottom.

Figure 8:
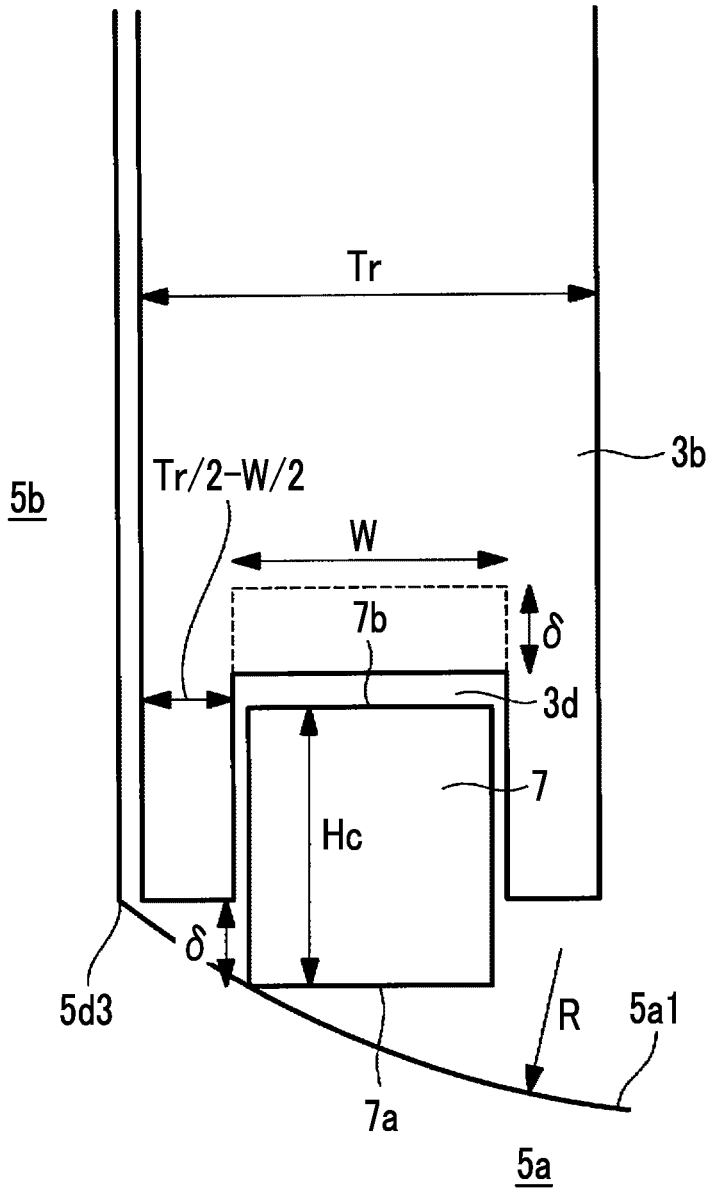
FIG. 8 is a horizontal sectional view around a tooth tip in a wall inclined portion.

FIG. 8 is a horizontal sectional view around the tooth tip when viewed from a sectional plane of the wall inclined portion 3*b*1 orthogonal in the spiral direction. In other words, FIG. 8 is a horizontal sectional view around the tooth tip when the wall inclined portion 3*b*1 from the wall inclined connection portion 3*b*4 on the inner peripheral side shown in FIG. 5 to the wall inclined connection portion 3*b*5 on the outer peripheral side shown in FIG. 5 is cut in a direction perpendicular to a paper surface. In addition, the tooth tip and the tip seal 7 of the orbiting scroll 5 are similarly configured.

The state shown in FIG. 8 is a state where the wall 5*b* of the orbiting scroll 5 and the wall 3*b* of the fixed scroll 3 adjacent to each other are closest to each other during an operation. The tip seal 7 is accommodated in the tip seal groove 3*d* formed in the tooth tip of the tip of the wall 3*b*. A horizontal cross section of the tip seal 7 has a substantially rectangular shape, and a flat tip surface (lower surface) 7*a* protrudes from the tooth tip of the wall 3*b* by the protrusion amount δ. In addition, the protrusion amount δ is an amount only during the operation, and in a case where a gas pressure is not applied to the back surface of the tip seal when the operation is stopped, the tip seal may sink into the tip seal groove and the protrusion amount may be less than or equal to zero.

The tooth bottom of the end plate 5*a* facing the wall 3*b* has an arc shape in which a central portion in the width direction is formed deeper than both side portions 5*d*3. The arc shape is a radius R, which will be described later. Accordingly, the cross section of the tooth bottom of the end plate 5*a* is formed in a shape of a turtle. A horizontal cross section of the tooth bottom of the end plate 5*a* formed in the shape of a turtle is formed over the entire end plate inclined portion 5*a*1.

Figure 9A:
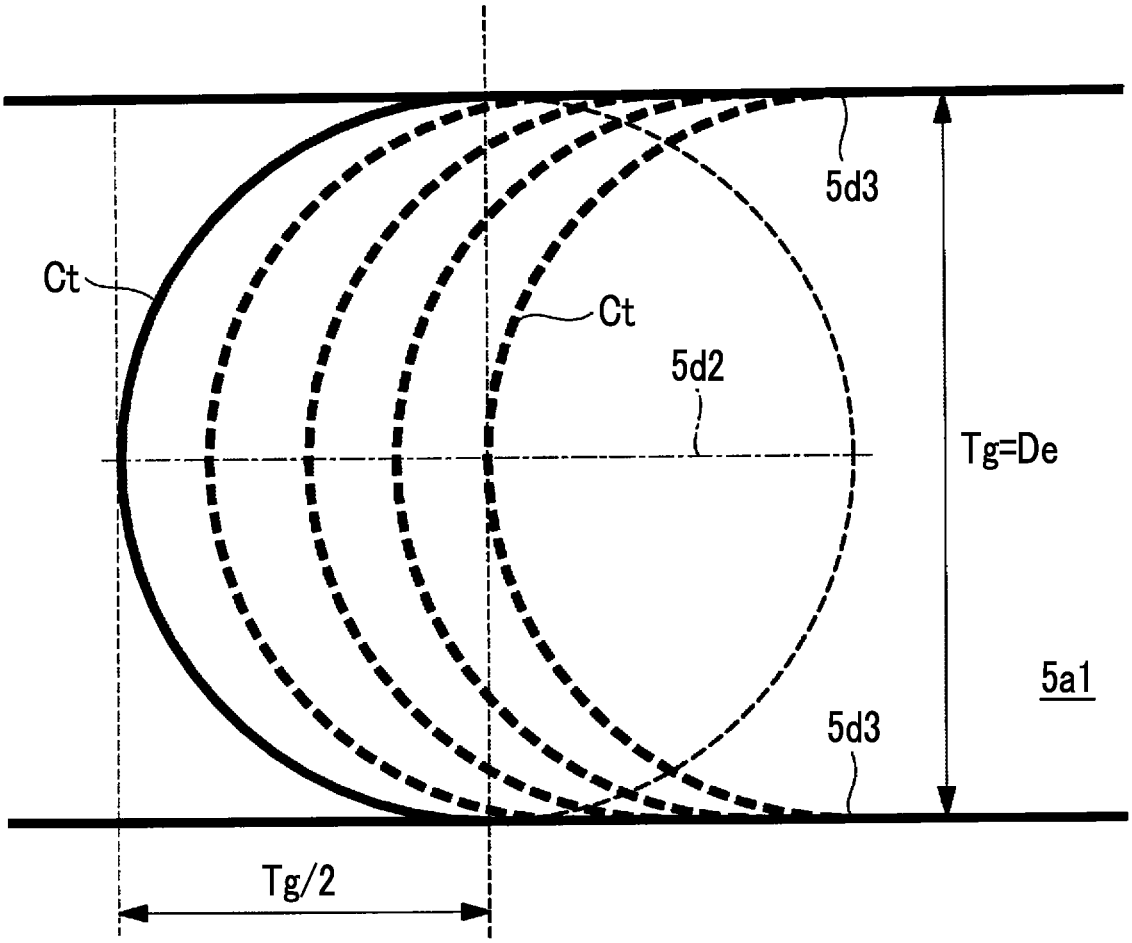
FIG. 9A is a plan view of a tooth bottom showing a tooth bottom shape of an end plate.
Figure 9B:
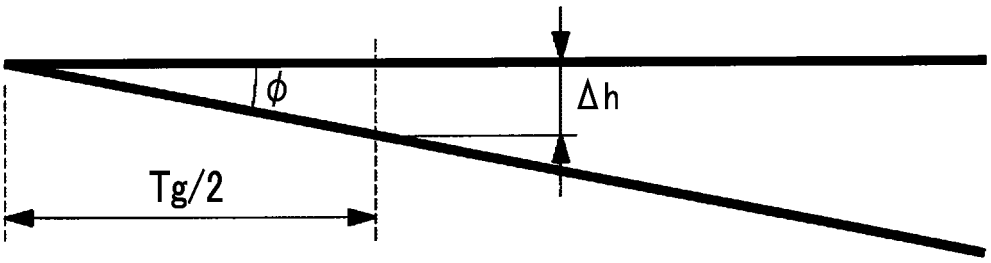
FIG. 9B is a schematic view showing a depth of a central portion of the tooth bottom of FIG. 9A.

As shown in FIGS. 9A and 9B, the above-described shape of the tooth bottom of the end plate 5*a* is generated by forming a contour line Ct. The contour line Ct has a width Tg of the tooth bottom of the end plate 5*a* as a diameter and is formed in a semicircular arc which protrudes in a height increase direction (left side in FIGS. 9A and 9B) of the end plate inclined portion 5*a*1. That is, a radius of the contour line Ct is Tg/2. As can be seen from FIG. 9B, the inclination of the end plate inclined portion 5*a*1 is φ (refer to FIG. 5), and thus, a depression amount Δh of a central portion 5*d*2 of the tooth bottom from both side portions 5*d*3 is represented by the following Expression.

$$\Delta h=(Tg/2)\times\tan\varphi \tag{2}$$

Figure 10A:
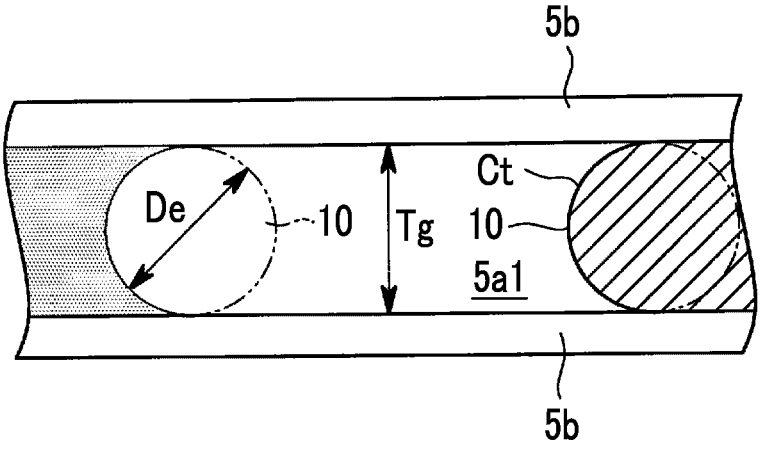
FIG. 10A show a method for processing the tooth bottom of the end plate and is a plan view of the tooth bottom.
Figure 10B:
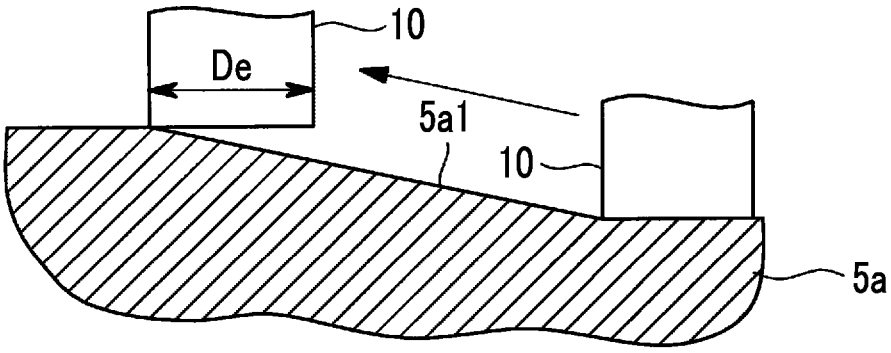
FIG. 10B is a side view corresponding to FIG. 10A and showing the tooth bottom.

The shape of the tooth bottom shown in FIG. 9A is obtained by performing processing using an end mill 10 shown in FIGS. 10A and 10B. A diameter De of the end mill 10 is the same as the width Tg of the tooth bottom. By the end mill 10, the tooth bottom is processed with one pass in one direction in which the inclination increases. The processing is performed such that a rotation axis of the end mill 10 is parallel to an axis passing through the center O2 (refer to FIG. 1A) of the orbiting scroll 5. Accordingly, as shown in FIG. 9A, the contour line Ct having a semicircular arc shape is formed.

Figure 11:
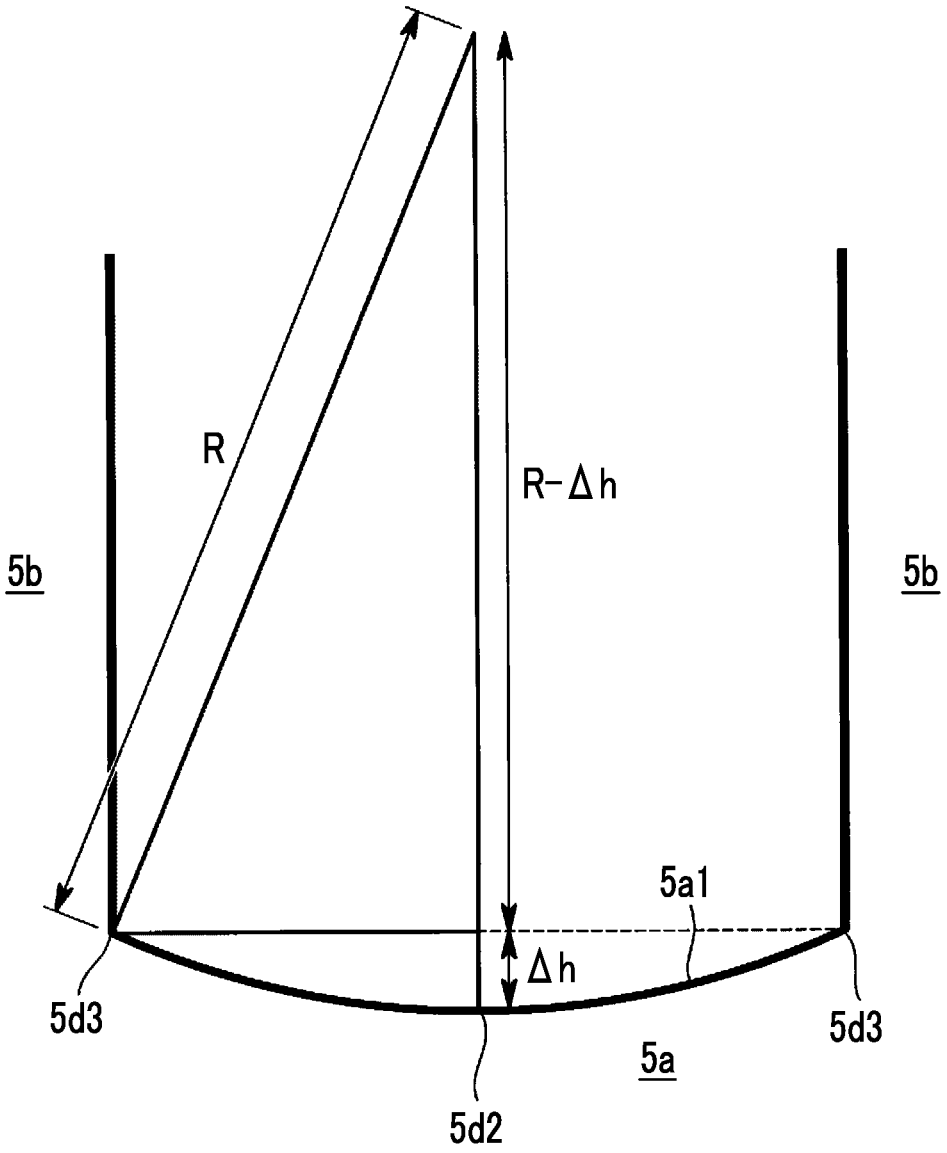
FIG. 11 is a horizontal sectional view of the tooth bottom of the end plate.

As shown in FIG. 11, the tooth bottom of the end plate 5*a* is formed in an arc shape having a radius R. That is, the tooth bottom is formed in an arc shape having the radius R which passes through the central portion 5*d*2 protruding by the depression amount Δh from both side portions 5*d*3 and both side portions 5*d*3.

Figure 12:
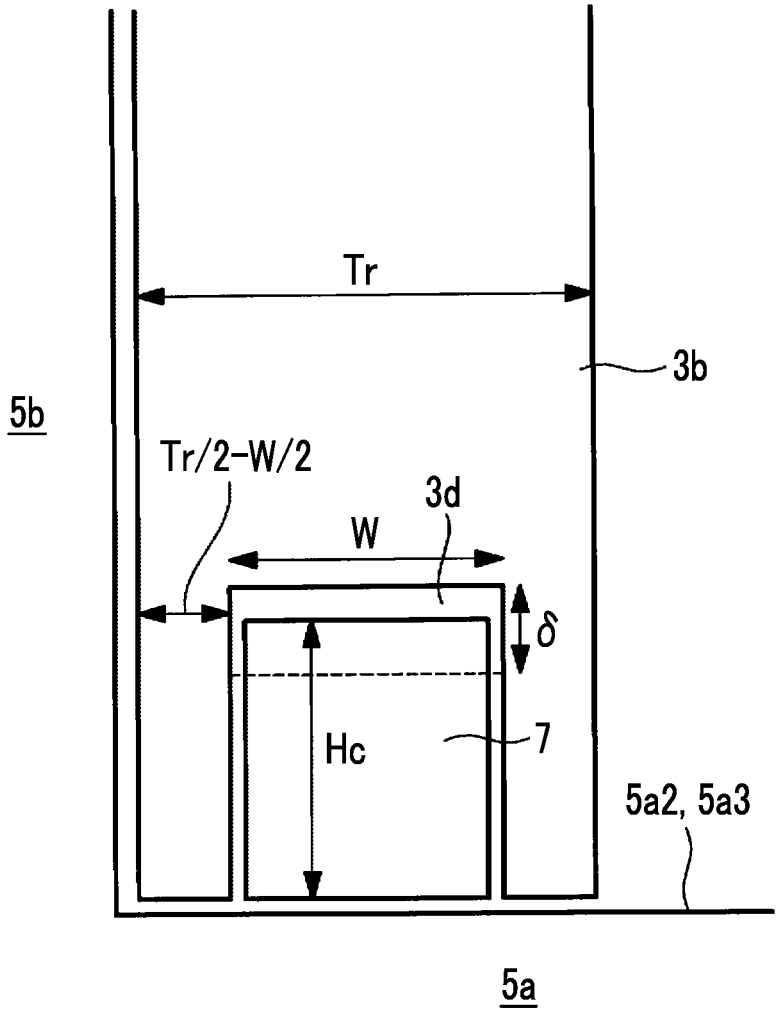
FIG. 12 is a horizontal sectional view around the tooth tip in the wall flat portion.

As shown in FIG. 12, in each of the end plate flat portions 5*a*2 and 5*a*3, the tooth bottom of the end plate 5*a* is flat. This is because each of the end plate flat portions 5*a*2 and 5*a*3 is not inclined unlike the end plate inclined portions 5*a*1, and thus, the flat surface is formed by processing of the end mill 10. Accordingly, the entire tip surface 7*a* which becomes a flat surface of the tip seal 7 comes into contact with the tooth bottom, a protrusion amount of tip seal 7 protruding from the tooth tip is approximately 0 to slightly protruding, and is smaller than the protrusion amount δ (see FIG. 8). In addition, the state shown in FIG. 12 shows a state in which the wall 5*b* of the orbiting scroll 5 and the wall 3*b* of the fixed scroll 3 adjacent to each other are closest to each other. The height Hc of the tip seal 7 in the flat portion is equal to the height Hc of the tip seal in the inclined portion.

[Setting of Protrusion Amount δ]

Next, as shown in FIG. 8, setting of the protrusion amount δ in which the tip seal 7 protrudes from the tooth tip will be described. The protrusion amount δ is expressed as a function of the inclination φ, the end mill diameter De, a tooth thickness of the wall 3*b*, and a tip seal groove width W. The tooth thickness of the wall 3*b* means a width on one side of the tooth tip of the wall 3*b* excluding the tip seal groove 3*d*, and when the thickness of the wall 3*b* is Tr, and the tooth thickness can be expressed by Tr/2−W/2.

The protrusion amount δ is as follows.

$$\delta=[R^2-\{De/2-(Tr/2-W/2)\}^2]^{1/2}-(R-\Delta h) \tag{3}$$

A depth of the tip seal groove 3*d* can be reduced by an amount corresponding to the projection amount δ expressed by the above Expression. Specifically, compared to the tip seal groove 3*d* of the tooth tip facing the end plate flat portions 5*a*2 and 5*a*3 as shown in FIG. 12, in the tip seal groove 3*d* of the tooth tip facing the end plate inclined portion 5*a*1 as shown in FIG. 8, the groove depth can be reduced by the protrusion amount δ.

The above-described scroll compressor 1 is operated as follows. The orbiting scroll 5 performs the revolution orbiting movement around the fixed scroll 3 by a drive source such as an electric motor (not shown). Accordingly, the fluid is sucked from the outer peripheral sides of the respective scrolls 3 and 5, and the fluid is taken into the compression chambers surrounded by the respective walls 3*b* and 5*b* and the respective end plates 3*a* and 5*a*. The fluid in the compression chambers is sequentially compressed while being moved from the outer peripheral side toward the inner peripheral side, and finally, the compressed fluid is discharged from a discharge port 3*c* formed in the fixed scroll 3. When the fluid is compressed, the fluid is compressed in the height directions of the walls 3*b* and 5*b* in the inclined portions formed by the end plate inclined portions 3*a*1 and 5*a*1 and the wall inclined portions 3*b*1 and 5*b*1, and thus, the fluid is three-dimensionally compressed.

According to the present embodiment, the following operational effects are exerted. If each of the end plate inclined portions 3*a*1 and 5*a*1 has the shape in which the central part is deeper than the side portion in the width direction, the tip of the tip seal 7 protrudes from the tip seal groove 3*d* by an amount which is deeper than the side portion (refer to FIG. 8). Accordingly, compared to the case where the end plates 3*a* and 5*a* are flat (refer to FIG. 12), a back clearance between the bottom portion of the tip seal groove 3*d* and the back surface of the tip seal 7. If the back clearance increases, the refrigerant flows from a high-pressure side compression chamber to a low-pressure side compression chamber through the back clearance, and thus, a fluid loss is generated. Accordingly, the protrusion amount δ of tip seal 7 in each of the wall inclined portions 3*b*1 and 5*b*1 is made larger than the protrusion amount of tip seal 7 in each of the wall flat portions 3*b*2, 3*b*3, 5*b*2 and 5*b*3 such that an increase in the back clearance in the inclined portion is suppressed. Accordingly, the fluid loss can be suppressed as much as possible.

The projection amount δ of the tip seal 7 is set to be smallest in the case where the wall inclined portions 3*b*1 and 5*b*1 are closest to the adjacent wall inclined portions (the state shown in FIG. 8). Accordingly, the fluid loss can be suppressed as much as possible.

In the case where the wall inclined portions 3*b*1 and 5*b*1 are closest to each other, if the protrusion amount δ of the tip seal 7 is set as in the above Expression (3) based on a depth (refer to FIG. 8) at which the tip of the tip seal 7 abuts on a position deeper than the side portion of each of the end plate inclined portions 3*a*1 and 5*a*1, the back clearance of the inclined portion can be made as small as possible.

In addition, in the present embodiment, in the present embodiment, the back clearance is adjusted by the depth of the tip seal groove 3*d*. However, the back clearance may be adjusted by the height Hc (refer to FIG. 8) of the tip seal 7 or may be adjusted using both the depth of the tip seal groove 3*d* and the height Hc of the tip seal 7.

Figure 13:
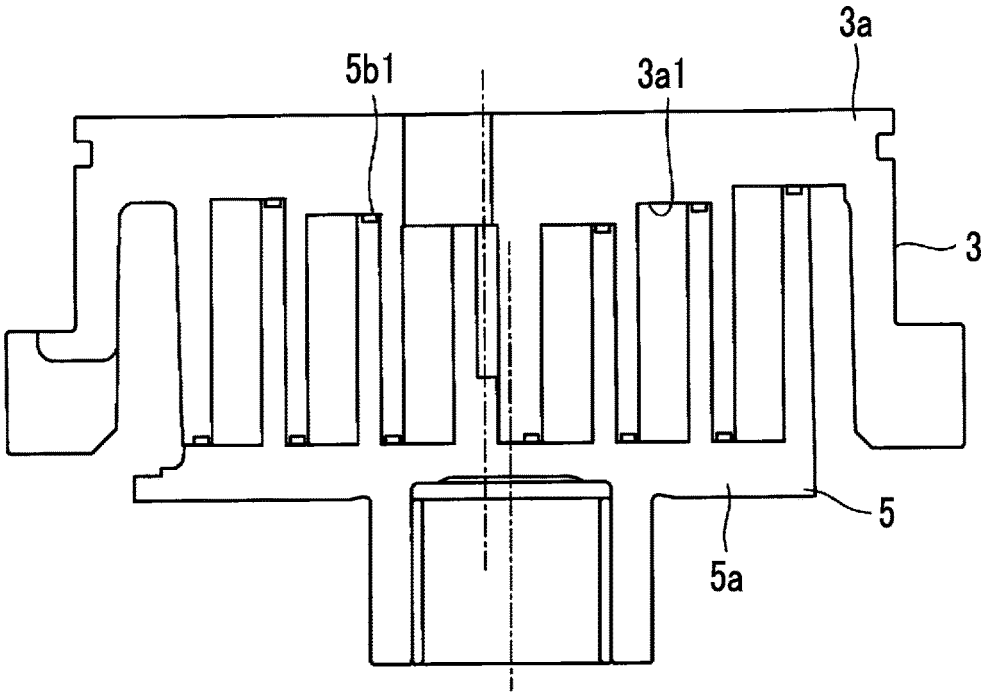
FIG. 13 is a longitudinal section view showing a combination with a scroll which does not have a step portion.
Figure 14:
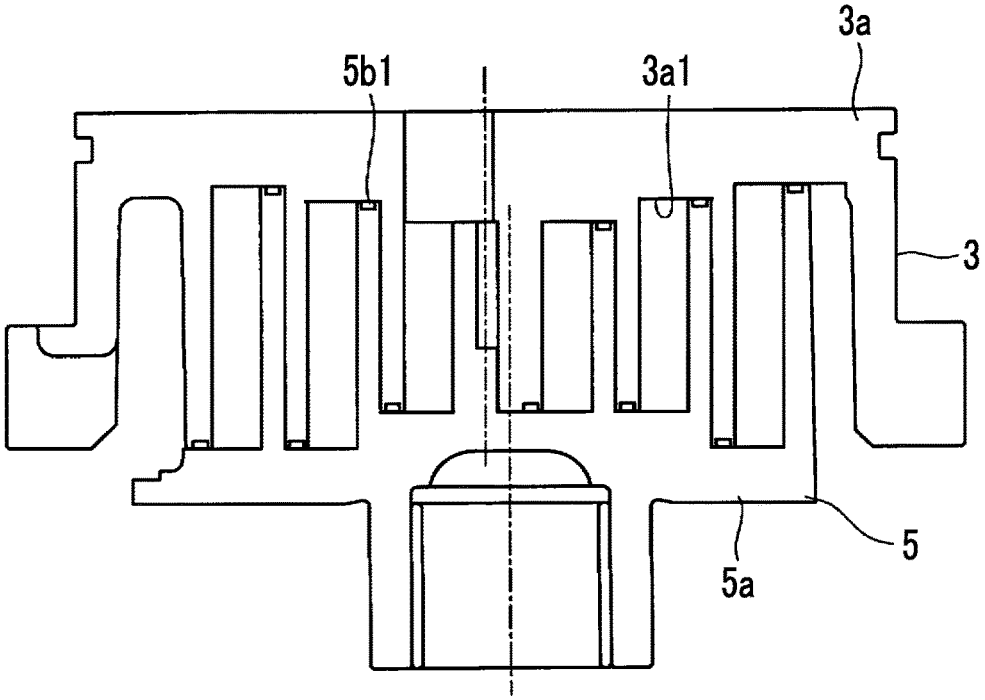
FIG. 14 is a longitudinal section view showing a combination with a stepped scroll.

Moreover, in the present embodiment, although the end plate inclined portions 3*a*1 and 5*a*1 and the wall inclined portions 3*b*1 and 5*b*1 are provided on both the scrolls 3 and 5. However, they may be provided in any one of the scrolls 3 and 5. Specifically, as shown in FIG. 13, in a case where the wall inclined portion 5*b*1 is provided in one wall (for example, orbiting scroll 5) and the end plate inclined portion 3*a*1 is provided in the other end plate 3*a*, the other wall and one end plate 5*a* may be flat. In addition, as shown in FIG. 14, a shape combined with a stepped shape of the related art may be adopted, that is, the shape in which the end plate inclined portion 3*a*1 is provided in the end plate 3*a* of the fixed scroll 3 may be combined with a shape in which the step portion is provided in the end plate 5*a* of the orbiting scroll 5.

In the present embodiment, the wall flat portions 3*b*2, 3*b*3, 5*b*2, and 5*b*3 and the end plate flat portions 3*a*2, 3*a*3, 5*a*2, and 5*a*3 are provided. However, the flat portions on the inner peripheral side and/or the outer peripheral side may be omitted, and the inclined portion may be provided so as to extend to the entire walls 3*b* and 5*b*.

In the present embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)
3*a*: end plate (first end plate)
3*a*1: end plate inclined portion
3*a*2: end plate flat portion
3*a*3: end plate flat portion
3*a*4: end plate inclined connection portion
3*a*5: end plate inclined connection portion
3*b*: wall (first wall)
3*b*1: wall inclined portion
3*b*2: wall flat portion
3*b*3: wall flat portion
3*b*4: wall inclined connection portion
3*b*5: wall inclined connection portion
3*c*: discharge port
3*d*: tip seal groove
5: orbiting scroll (second scroll member)
5*a*: end plate (second end plate)
5*a*1: end plate inclined portion
5*a*2: end plate flat portion
5*a*3: end plate flat portion
5*a*4: end plate inclined connection portion
5*a*5: end plate inclined connection portion
5*b*: wall (second wall)
5*b*1: wall inclined portion
5*b*2: wall flat portion
5*b*3: wall flat portion
5*b*4: wall inclined connection portion
5*b*5: wall inclined connection portion
7: tip seal
7*a*: tip surface
10: end mill
Ct: contour line
D1: division position (of tip seal)
De: end mill diameter
Hc: height of tip seal
L: inter-facing surface distance
T: tip clearance
Tg: width of tooth bottom
Tr: thickness of wall
W: tip seal groove width
δ: protrusion amount (of tip seal)
φ: inclination
Δh: depression amount

The invention claimed is:

1. A scroll fluid machine comprising:

a first scroll member having a first end plate on which a spiral first wall is provided; and a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein at least one of the first wall and the second wall has a wall inclined portion, in which a height of the at least one of the first wall and the second wall continuously decreases from the outer peripheral side toward the inner peripheral side, to form the inclined portion, wherein at least one of the first end plate and the second end plate has an end plate inclined portion in which a tooth bottom surface facing a tooth tip of the wall inclined portion is inclined according to an inclination of the wall inclined portion, wherein the inclined portion is constituted by the wall inclined portion and the end plate inclined portion, wherein a wall flat portion whose height is not changed is provided on outermost peripheral portions and/or innermost peripheral portions of the first wall and the second wall, wherein an end plate flat portion corresponding to the wall flat portion is provided on the first end plate and the second end plate, wherein a tip seal which comes into contact with a facing end plate to perform sealing for a fluid is provided in a tip seal groove formed in a tooth tip of each of the first wall and the second wall, wherein the end plate inclined portion is configured such that a central portion is deeper than a side portion in a width direction of a tooth bottom, and wherein during an operation, a protrusion amount measured when the tip seal protrudes from the tooth tip of the wall inclined portion in the wall inclined portion and comes into contact with the facing end plate is larger than a protrusion amount measured when the tip seal protrudes from a tooth tip of the wall flat portion in the wall flat portion and comes into contact with the facing end plate, wherein a thickness of the tip seal on the first wall in a height direction of the first wall is constant in the spiral direction of the first wall, and a thickness of the tip seal on the second wall in a height direction of the second wall is constant in the spiral direction of the second wall, and wherein a depth of the tip seal groove is shallower in the wall inclined portion than in the wall flat portion.

2. The scroll fluid machine according to claim 1, wherein in a case where the wall inclined portion is closest to an adjacent wall inclined portion, a protrusion amount of the tip seal is determined based on such a depth that a tip of the tip seal abuts on a position deeper than the side portion of the end plate inclined portion.

3. A scroll fluid machine comprising:

a first scroll member having a first end plate on which a spiral first wall is provided; and a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein at least one of the first wall and the second wall has a wall inclined portion, in which a height of the at least one of the first wall and the second wall continuously decreases from the outer peripheral side toward the inner peripheral side, to form the inclined portion, wherein at least one of the first end plate and the second end plate has an end plate inclined portion in which a tooth bottom surface facing a tooth tip of the wall inclined portion is inclined according to an inclination of the wall inclined portion, wherein the inclined portion is constituted by the wall inclined portion and the end plate inclined portion, wherein a wall flat portion whose height is not changed is provided on outermost peripheral portions and/or innermost peripheral portions of the first wall and the second wall, wherein an end plate flat portion corresponding to the wall flat portion is provided on the first end plate and the second end plate, wherein a tip seal which comes into contact with a facing end plate to perform sealing for a fluid is provided in a tip seal groove formed in a tooth tip of each of the first wall and the second wall, wherein the end plate inclined portion is configured such that a central portion is deeper than a side portion in a width direction of a tooth bottom, and wherein during an operation, a protrusion amount measured when the tip seal protrudes from the tooth tip of the wall inclined portion in the wall inclined portion and comes into contact with the facing end plate is larger than a protrusion amount measured when the tip seal protrudes from a tooth tip of the wall flat portion in the wall flat portion and comes into contact with the facing end plate, wherein a depth of the tip seal groove formed in the first wall is constant in the spiral direction of the first wall and a depth of the tip seal groove formed in the second wall is constant in the spiral direction of the second wall, and wherein a thickness of the tip seal on the first wall in a height direction of the first wall is larger in the wall inclined portion than in the wall flat portion, and/or a thickness of the tip seal on the second wall in a height direction of the second wall is larger in the wall inclined portion than in the wall flat portion.

4. The scroll fluid machine according to claim 3, wherein in a case where the wall inclined portion is closest to an adjacent wall inclined portion, a protrusion amount of the tip seal is determined based on such a depth that a tip of the tip seal abuts on a position deeper than the side portion of the end plate inclined portion.

5. A scroll fluid machine comprising:

a first scroll member having a first end plate on which a spiral first wall is provided;

a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein at least one of the first wall and the second wall has a wall inclined portion, in which a height of the at least one of the first wall and the second wall continuously decreases from the outer peripheral side toward the inner peripheral side, to form the inclined portion, wherein at least one of the first end plate and the second end plate has an end plate inclined portion in which a tooth bottom surface facing a tooth tip of the wall inclined portion is inclined according to an inclination of the wall inclined portion, wherein the inclined portion is constituted by the wall inclined portion and the end plate inclined portion, wherein a tip seal which comes into contact with the facing end plate inclined portion to perform sealing for a fluid is provided in a tip seal groove formed on each tooth tip of the first wall and the second wall corresponding to the inclined portion, wherein the end plate inclined portion is configured such that a central portion is deeper than a side portion in a width direction of a tooth bottom, and wherein during an operation, a protrusion amount measured when the tip seal protrudes from the tooth tip of the wall inclined portion and comes into contact with the facing end plate is smallest when the wall inclined portion is closest to an adjacent wall inclined portion, wherein in a case where the wall inclined portion is closest to the adjacent wall inclined portion, a protrusion amount of the tip seal is determined based on such a depth that a tip of the tip seal abuts on a position deeper than the side portion of the end plate inclined portion, and a back clearance between a bottom portion of the tip seal groove and a back surface of the tip seal is adjusted using a depth of the tip seal groove and/or a thickness of the tip seal such that an increase in the back clearance is suppressed.

6. A scroll fluid machine comprising:

a first scroll member having a first end plate on which a spiral first wall is provided; and a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein at least one of the first wall and the second wall has a wall inclined portion, in which a height of the at least one of the first wall and the second wall continuously decreases from the outer peripheral side toward the inner peripheral side, to form the inclined portion, wherein at least one of the first end plate and the second end plate has an end plate inclined portion in which a tooth bottom surface facing a tooth tip of the wall inclined portion is inclined according to an inclination of the wall inclined portion, wherein the inclined portion is constituted by the wall inclined portion and the end plate inclined portion, wherein a tip seal which comes into contact with the facing end plate inclined portion to perform sealing for a fluid is provided in a tip seal groove formed on each tooth tip of the first wall and the second wall corresponding to the inclined portion, and wherein a tooth bottom of the end plate inclined portion is formed in an arc shape in which a central portion is deeper than a side portion in a width direction of a tooth bottom and which is recessed from the side portion and is convex downward.

* * * * *